US008517505B2

(12) United States Patent
Kawakami

(10) Patent No.: US 8,517,505 B2
(45) **Date of Patent: *Aug. 27, 2013**

(54) FLUID EJECTING APPARATUS AND FLUID RECEIVING METHOD

(75) Inventor: Takayuki Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 219 days.

This patent is subject to a terminal disclaimer.

(21) Appl. No.: 12/975,642

(22) Filed: Dec. 22, 2010

(65) Prior Publication Data

US 2011/0157290 A1 Jun. 30, 2011

(30) Foreign Application Priority Data

Dec. 25, 2009 (JP) ..... 2009-295641

(51) Int. Cl.
*B41J 2/165* (2006.01)

(52) U.S. Cl.
CPC ..... *B41J 2/16526* (2013.01)
USPC ..... 347/31; 347/32

(58) Field of Classification Search
USPC ..... 347/105, 31, 35
See application file for complete search history.

(56) References Cited

U.S. PATENT DOCUMENTS

| | | | | |
|---|---|---|---|---|
| 5,557,307 | A * | 9/1996 | Paroff | 347/34 |
| 5,847,674 | A * | 12/1998 | Paroff et al. | 347/33 |
| 6,189,989 | B1 * | 2/2001 | Hirabayashi et al. | 347/4 |
| 7,562,961 | B2 | 7/2009 | Inoue | |
| 2005/0062797 | A1 | 3/2005 | Kachi | |
| 2005/0268769 | A1 * | 12/2005 | Zager | 84/314 N |
| 2006/0066664 | A1 | 3/2006 | Kachi et al. | |
| 2010/0118084 | A1 | 5/2010 | Seshimo | |

FOREIGN PATENT DOCUMENTS

| | | |
|---|---|---|
| JP | 2005-119284 | 5/2005 |

* cited by examiner

*Primary Examiner* — Manish S Shah
*Assistant Examiner* — Jeffrey C Morgan
(74) *Attorney, Agent, or Firm* — Workman Nydegger

(57) ABSTRACT

Provided is a fluid ejecting apparatus including: a fluid ejecting head; a receiving member which is linear; a support member which supports the receiving member; a support member movement unit which moves the support member between a first position and a second position so that the receiving member is located at a receiving position capable of receiving the fluid ejected from the nozzles at the first position, and the receiving member is located at a retreat position deviating from the receiving position at the second position; and a tensile force changing unit which is capable of changing tensile force changing unit changes the tensile force applied to the receiving member from a first tensile force to a second tensile force smaller than the first tensile force when the support member movement unit moves the support member from the second position to the first position.

6 Claims, 5 Drawing Sheets

FLUID EJECTING APPARATUS AND FLUID RECEIVING METHOD

BACKGROUND

1. Technical Field

The present invention relates to a fluid ejecting apparatus such as an ink jet printer and a fluid receiving method.

2. Related Art

In general, an ink jet printer (hereinafter, simply referred to as a "printer") has been known as a fluid ejecting apparatus that ejects a fluid from a nozzle formed on a fluid ejecting head toward a target. In the printer, if ink (fluid) is not ejected for some time from a specific nozzle during a printing process, the ink in the nozzle is thickened or solidified, dust becomes attached to the nozzle, or bubbles become mixed with the ink in the nozzle, which may cause an erroneous ejecting of the ink. Therefore, generally, the printer performs a flushing process in which the ink is ejected from the nozzle on the basis of a control signal not involved with the printing process.

That is, for example, in a serial type printer designed to perform a printing process while a printing head scans the primary scanning direction, the flushing process is performed in such a manner that the printing head moves to a position deviating from the printing area and the ink is ejected toward a flushing box directly disposed below the printing head. Further, in a line head type printer designed to use a large printing head corresponding to the width of the printing sheet, JP-A-2005-119284 discloses a configuration in which an absorbing member (a receiving member) is provided in a transportation belt used to transport a printing sheet and the ink is ejected to the absorbing member.

However, in the case of the printer disclosed in JP-A-2005-119284, the absorbing member needs to directly face the nozzle during the flushing process. For this reason, the flushing process cannot be performed when the printing process is performed on an elongated sheet such as a continuous sheet. Further, since the ink needs to be ejected to the absorbing member at a timing at which the absorbing member is disposed and transported between the printing sheets and faces the printing head, a problem arises in that constraints on the size or the transportation speed of the printing sheet occur. Furthermore, since the flushing process is performed on the planar absorbing member in the printer disclosed in JP-A-2005-119284, mist-like ink scatters due to wind pressure accompanying the ejection of the ink, raising concerns that the inside of the printer may be contaminated.

Therefore, a method has been proposed in which a linear absorbing member moves within an empty area formed between a printing sheet and the printing head to face a nozzle, and ink is ejected from the nozzle to the absorbing member stopping at the facing position, where the flushing process is performed easily within a short period of time.

However, when the absorbing member is formed as a linear shape, the area capable of receiving the ink in the absorbing member decreases more than that of the planar absorbing member. In addition, when the linear absorbing member moving within the empty area formed between the printing sheet and the printing head stops at the position facing the nozzle, the linear absorbing member may be easily vibrated compared with the planar absorbing member.

For this reason, when the absorbing member is formed as a linear shape, since the absorbing member is vibrated, the absorbing member may deviate from the area capable of receiving the ink in the absorbing member, which raises concerns that the inside of the printer may be contaminated.

SUMMARY

An advantage of some aspects of the invention is that it provides a fluid ejecting apparatus capable of rapidly and easily receiving a fluid ejected from a nozzle to a receiving member even when the linear receiving member moves and stops at a position capable of receiving the fluid ejected from the nozzle, and a fluid receiving method.

According to an aspect of the invention, there is provided a fluid ejecting apparatus including: a fluid ejecting head which includes nozzles ejecting a fluid; a linear receiving member which is capable of receiving the fluid ejected from the nozzles; a support member which supports the receiving member so as to extend in a linear shape; a support member movement unit which moves the support member between a first position and a second position so that the receiving member is located at a receiving position capable of receiving the fluid ejected from the nozzles at the first position, and the receiving member is located at a retreat position deviating from the receiving position at the second position; and a tensile force changing unit which is capable of changing a tensile force applied to the receiving member supported by the support member to extend in a linear shape, wherein the tensile force changing unit changes the tensile force applied to the receiving member from a first tensile force to a second tensile force smaller than the first tensile force when the support member movement unit moves the support member from the second position to the first position.

According to this configuration, the tensile force changing unit applies the first tensile force larger than the second tensile force to the receiving member when the support member movement unit moves the support member. Therefore, the receiving member moves while its deformation is suppressed. However, since the restoration force increases as the tensile force increases, when the receiving member having the large tensile force applied thereto is decelerated, the receiving member may be vibrated even when the amount of deformation is small. For this reason, if the tensile force of the receiving member changes to the second tensile force smaller than the first tensile force when the support member moves to the first position, the restoration force is weakened, thereby suppressing vibration thereof. Accordingly, even when the linear receiving member moves and stops at the receiving position capable of receiving the fluid ejected from the nozzles, it is possible to rapidly and easily receive the fluid ejected from the nozzles by using the receiving member.

In the fluid ejecting apparatus of the aspect, the support member movement unit accelerates and decelerates the support member so as to move the support member from the retreat position to the receiving position. The tensile force changing unit changes the tensile force applied to the receiving member from the first tensile force to the second tensile force when the support member movement unit decelerates the movement speed of the support member so as to stop the support member at the first position.

When the moving support member is decelerated, the receiving member supported by the support member may be vibrated due to the inertia force and the restoration force of the receiving member. For this reason, according to this configuration, since the tensile force changing unit changes the tensile force applied to the receiving member to the second tensile force smaller than the first tensile force before the support member is located at the receiving position, the receiving member reaches the receiving position while the restoration force thereof is weakened. That is, since the receiving member is located at the receiving position while the vibration thereof is suppressed, it is possible to rapidly eject the fluid to the receiving member.

In the fluid ejecting apparatus of the aspect, the support member is a winding shaft that winds and supports at least one end of the receiving member, and further includes a motor capable of rotationally driving the winding shaft in the normal and reverse directions. The tensile force changing unit changes the tensile force of the receiving member having the end wound on the winding shaft by rotating the winding shaft through the rotational driving of the motor.

According to this configuration, it is possible to easily change the tensile force applied to the receiving member by rotating the winding shaft having the receiving member wound thereon.

The fluid ejecting apparatus of the aspect further includes: a contact member which is capable of coming into contact with the receiving member, wherein the tensile force changing unit changes the tensile force applied to the receiving member in such a manner that the contact member comes into contact with the receiving member to deform the receiving member while moving relative to the receiving member in a direction intersecting the extension direction of the receiving member.

According to this configuration, it is possible to easily change the tensile force applied to the receiving member in such a manner that the contact member comes into contact with the receiving member to deform the receiving member.

According to another aspect of the invention, there is provided a fluid receiving method of receiving a fluid ejected from nozzles into a receiving member supported to extend in a linear shape, the method including: moving the receiving member toward a receiving position capable of receiving the fluid ejected from the nozzles while applying a tensile force to the receiving member; changing the tensile force applied to the receiving member from a first tensile force to a second tensile force smaller than the first tensile force when the receiving member moves to the receiving position; and ejecting the fluid toward the receiving member stopping at the receiving position through the changing of the tensile force.

According to this configuration, it is possible to obtain the same advantages as that of the above fluid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment will be described with reference to the accompanying drawings, in which a fluid ejecting apparatus of the invention is embodied as an ink jet printer. Further, in the description below, the "longitudinal direction", the "horizontal direction", and the "vertical direction" respectively indicate the longitudinal direction, the horizontal direction, and the vertical direction depicted by the arrows in FIGS. 1 and 2.

Figure 1:
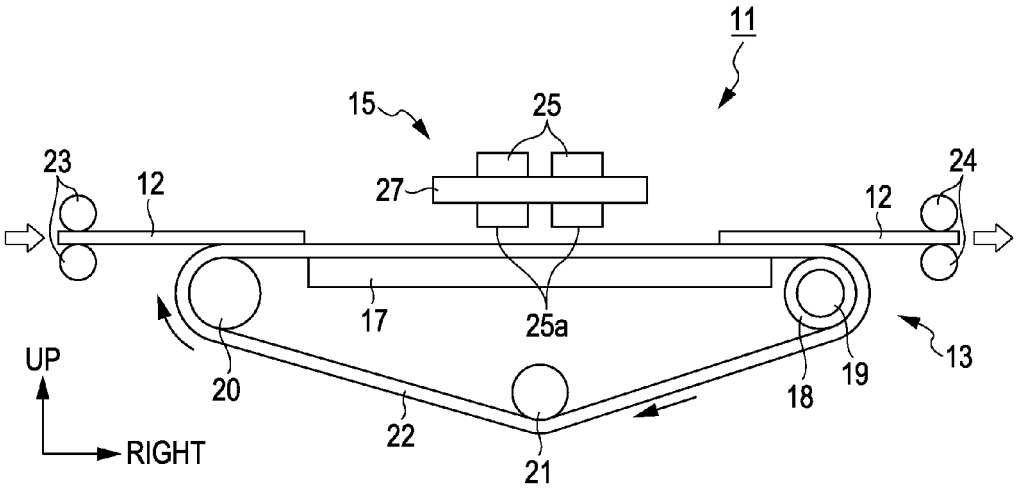
FIG. 1 is a front schematic diagram illustrating a printer of an embodiment.

As shown in FIG. 1, an ink jet printer (hereinafter, referred to as a "printer") 11 as a fluid ejecting apparatus includes a transportation unit 13 which transports a printing sheet 12 and a printing head unit 15 which performs a printing process on the printing sheet 12.

The transportation unit 13 includes a platen 17 which is formed as an elongated rectangular plate shape in the horizontal direction. A driving roller 18 extending in the longitudinal direction is disposed on the right side of the platen 17 so as to be rotationally driven by a driving motor 19, and a driven roller 20 extending in the longitudinal direction is disposed on the left side of the platen 17 so as to be rotatable. Further, a tension roller 21 extending in the longitudinal direction is disposed on the lower side of the platen 17 so as to be rotatable.

An endless transportation belt 22 having plural perforation holes (not shown) therein is wound on the driving roller 18, the driven roller 20, and the tension roller 21 so as to surround the platen 17. In this case, the tension roller 21 is biased downward by a spring member (not shown), and the looseness of the transportation belt 22 is suppressed by applying a tension to the transportation belt 22.

Then, if the driving roller 18 is rotationally driven in the clockwise direction when seen from the front side thereof, the transportation belt 22 rotates in the clockwise direction along the outside portions of the driving roller 18, the tension roller 21, and the driven roller 20 when seen from the front side thereof. Further, when the printing sheet 12 is located to face the upper surface of the platen 17, the printing sheet 12 is drawn toward the platen 17 by a suction portion (not shown) over the transportation belt 22, and is transported from the left side as the upstream side to the right side as the downstream side.

Further, a pair of sheet feeding rollers 23 is provided on the obliquely left upper side of the driven roller 20 so as to sequentially feed each of the plurality of printing sheets 12 not subjected to the printing process onto the transportation belt 22. On the other hand, a pair of sheet discharging rollers 24 is provided on the obliquely right upper side of the driving roller 18 so as to discharge each of the printing sheets 12 subjected to the printing process from the transportation belt 22.

Figure 2:
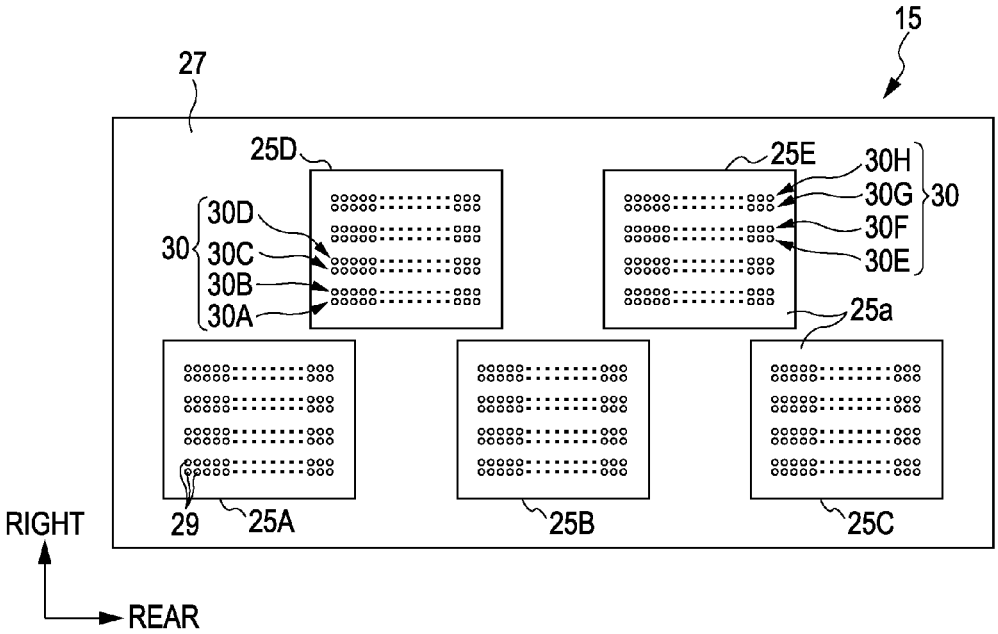
FIG. 2 is a schematic diagram illustrating a nozzle formation surface.

As shown in FIGS. 1 and 2, the printing head unit 15 has a configuration in which plural (in the embodiment, five) printing heads 25 (25A to 25E) as the fluid ejecting heads are disposed in a zigzag pattern in the width direction (the longitudinal direction) of the printing sheet 12 while being retained to a support plate 27. Then, a nozzle formation surface 25*a* formed on each of the lower surfaces of the printing heads 25 is provided with plural rows (in the embodiment, eight rows) of nozzle rows 30 (30A to 30H) which are regularly formed in the longitudinal direction with a predetermined pitch in the horizontal direction by plural nozzles 29. Further, the same kind of ink (fluid) is supplied to each pair of the nozzle rows 30 having the above-described configuration, and the ink is ejected from the nozzles 29.

That is, for example, black ink is supplied to the first and second nozzle rows 30A and 30B. Further, in the same way, cyan ink is supplied to third and fourth nozzle rows 30C and 30D, magenta ink is supplied to fifth and sixth nozzle rows 30E and 30F, and yellow ink is supplied to seventh and eighth nozzle rows 30G and 30H.

Figure 3:
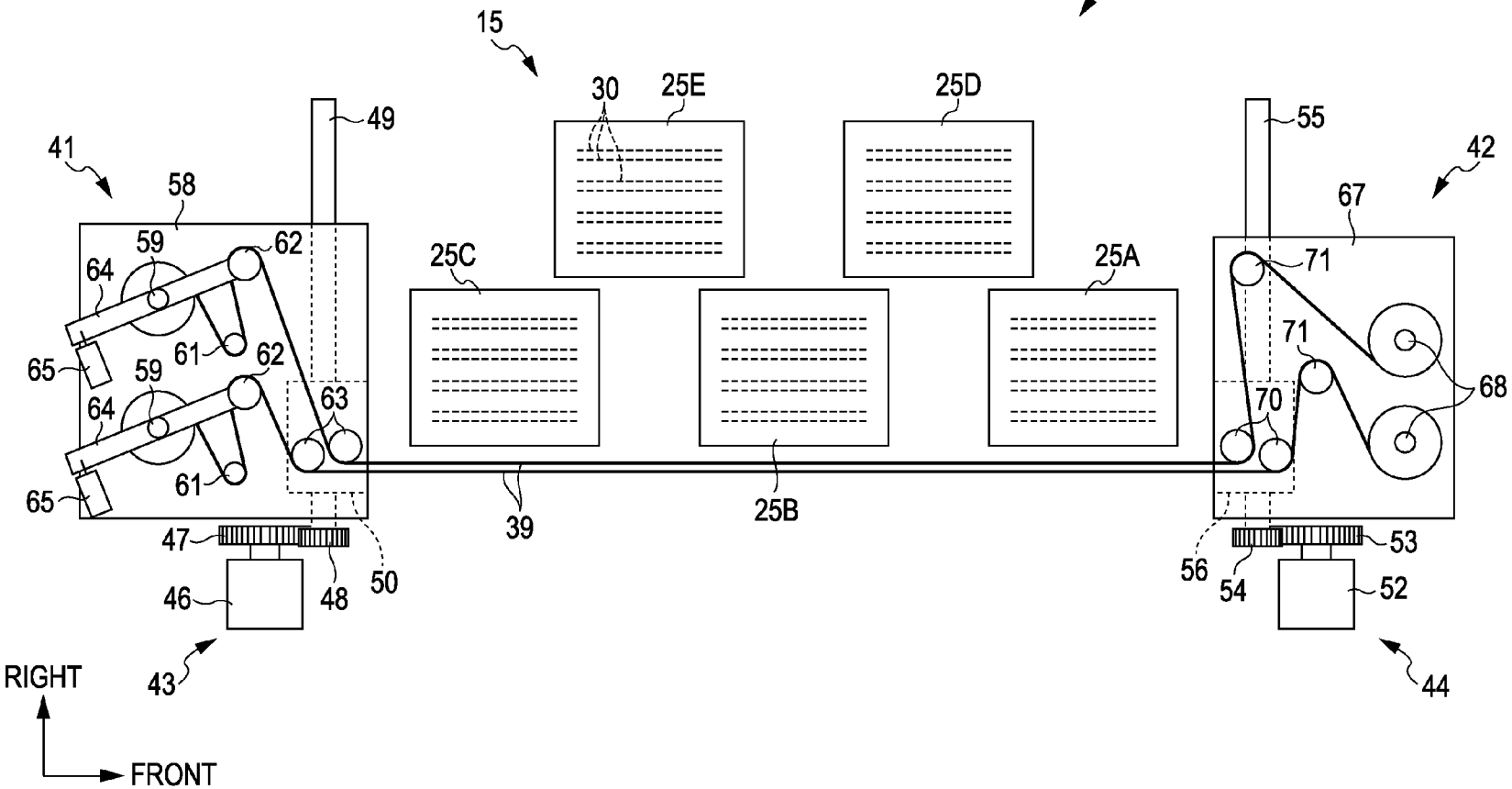
FIG. 3 is a schematic diagram illustrating a flushing unit that is located at a second position.

Further, as shown in FIG. 3, the printer 11 includes a flushing unit 40 which receives the ink (the fluid) ejected from the nozzles 29 by using a string member 39 as a linear receiving member during the flushing process.

The flushing unit 40 includes a supply portion 41 and a winding portion 42 which are provided with the printing head unit 15 interposed therebetween in the longitudinal direction, and support at least one (in the embodiment, two) string member 39 so as to be detachable therefrom. That is, the supply portion 41 and the winding portion 42 serve as support members that support the string member 39 as the receiving member so as to extend in a linear shape.

Then, the supply portion 41 and the winding portion 42 are adapted to be movable in a reciprocating manner in the horizontal direction using a pair of movement mechanisms 43 and 44 as units moving the support members. Therefore, both ends of the string member 39 are respectively supported by the supply portion 41 and the winding portion 42, and the string member 39 is movable in a reciprocating manner in the horizontal direction together with the supply portion 41 and the winding portion 42.

The first movement mechanism 43 includes a first driving gear 47 which is rotatable on the basis of a driving force of a first movement motor 46 and a first driven gear 48 which meshes with the first driving gear 47. A male screw is formed on an outer peripheral surface of a first shaft 49 that extends rightward from the center of the first driven gear 48, and a female screw hole formed in a first carriage 50 meshes with the male screw. Then, the supply portion 41 is fixed to the first carriage 50. Therefore, when the first movement motor 46 is driven so as to rotate the first shaft 49, the supply portion 41 moves in a reciprocating manner in the horizontal direction together with the first carriage 50.

In the same way, the second movement mechanism 44 includes a second movement motor 52, a second driving gear 53, a second driven gear 54, a second shaft 55 attached with a male screw, and a second carriage 56 attached with a female screw hole. Then, when the second shaft 55 rotates on the basis of the driving force of the second movement motor 52, the winding portion 42 fixed to the second carriage 56 moves in a reciprocating manner in the horizontal direction.

Here, the supply portion 41 includes a first stage 58 that is fixed to the first carriage 50. Then, a pair of winding shafts 59 is provided on the first stage 58 so as to be rotatable in accordance with the driving of a supply motor 60 (refer to FIG. 4), and first to third rollers 61 to 63 each formed as a pair are rotatably provided on the first stage 58. The string member 39 is rotatably wound on each of the winding shafts 59. Further, the string member 39 is sequentially wound on the first roller 61, the second roller 62, and the third roller 63, and is supplied from the supply portion 41.

Further, the second roller 62 is rotatably supported by a front end side of each of a pair of arms 64 that is tiltable about the center of the winding shaft 59. On the other hand, a solenoid 65 is provided on the rear end side of the arm 64 so as to displace the rear end of the arm 64, thereby applying a tensile force to the string member 39. That is, the solenoid 65 rotates the arm 64 so that the second roller 62 relatively moves in a direction intersecting the extension direction of the string member 39. Accordingly, the second roller 62 comes into contact with the string member 39 so as to deform the string member 39, and serves as a contact member that changes the tensile force applied to the string member 39.

On the other hand, the winding portion 42 includes a second stage 67 which is fixed to the second carriage 56. Then, a pair of winding shafts 68 is provided on the second stage 67 so as to be rotatable in accordance with the driving of a collection motor 69 (refer to FIG. 4), and fourth and fifth rollers 70 and 71 each formed as a pair are rotatably provided on the second stage 67. Then, the pair of string members 39 supplied from the supply portion 41 are sequentially and respectively wound on the fourth and fifth rollers 70 and 71, and are wound on the winding shafts 68.

Further, the pitch between a pair of third rollers 63 in the horizontal direction and the pitch between a pair of fourth rollers 70 in the horizontal direction are set to be equal to that of the nozzle rows 30 in the horizontal direction. That is, in the embodiment, the pitch between the pair of string members 39 in the horizontal direction is equal to the pitch between the nozzle rows (for example, the first nozzle row 30A and the second nozzle row 30B) ejecting the same ink in the horizontal direction.

Furthermore, the diameter (the thickness) of the string member 39 is set to be smaller than the gap between the nozzle formation surface 25*a* and the printing sheet 12, and to be larger than the diameter of the nozzle 29. That is, for example, when the gap between the printing sheet 12 and the nozzle formation surface 25*a* of the printing head 25 is about 2 mm and the diameter of the nozzle 29 is about 0.02 mm, it is desirable that the diameter of the string member 39 is set to 0.2 to 1 mm (which is 10 to 50 times the diameter of the nozzle 29). When the diameter of the string member 39 is about ten times the diameter of the nozzle 29, the ink can be received by the string member 39 even when the positional precision of the string member 39 and the nozzle 29 and manufacturing errors of the parts are counted in. In addition, when the diameter of the string member 39 is about fifty times the diameter of the nozzle 29, the string member 39 can pass through a space area formed between the nozzle formation surface 25*a* and the printing sheet 12.

Figure 4:
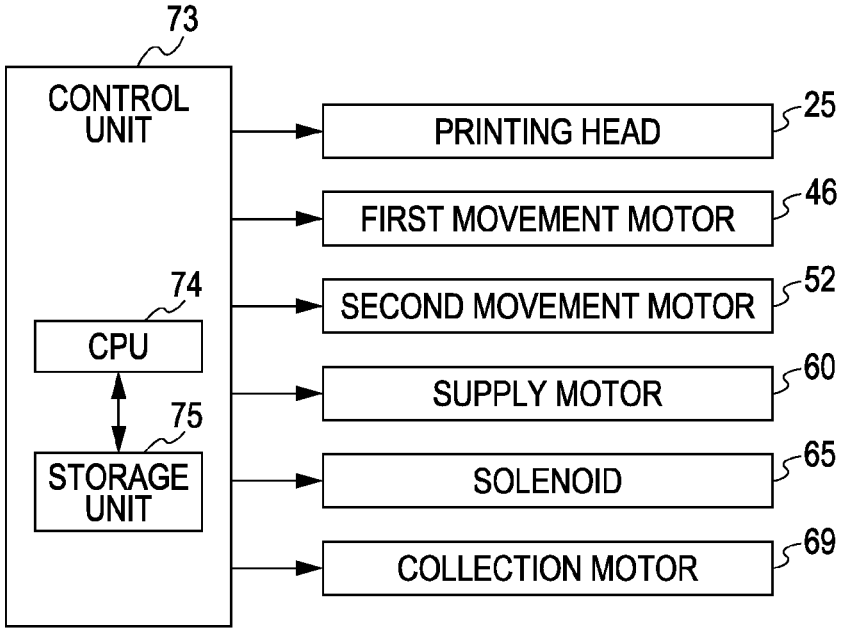
FIG. 4 is a block diagram illustrating a control unit.

Moreover, as shown in FIG. 4, the printer 11 includes a control unit 73 which is a tensile force changing unit generally controlling the operation state of the printer 11. The control unit 73 is configured as a digital computer that includes a CPU 74 which serves as a central processing unit and conducts various calculations, and a storage unit 75 which stores various programs. Then, the CPU 74 controls the printing heads 25 on the basis of the programs stored in the storage unit 75 so as to control the ejection of the ink from each of the nozzles 29, and to control the driving of the first and second movement motors 46 and 52, the supply motor 60, the solenoid 65, and the collection motor 69.

That is, for example, when the control unit 73 drives the first and second movement motors 46 and 52 to be rotated in the normal direction, the supply portion 41 and the winding portion 42 move between first and second positions.

Figure 5:
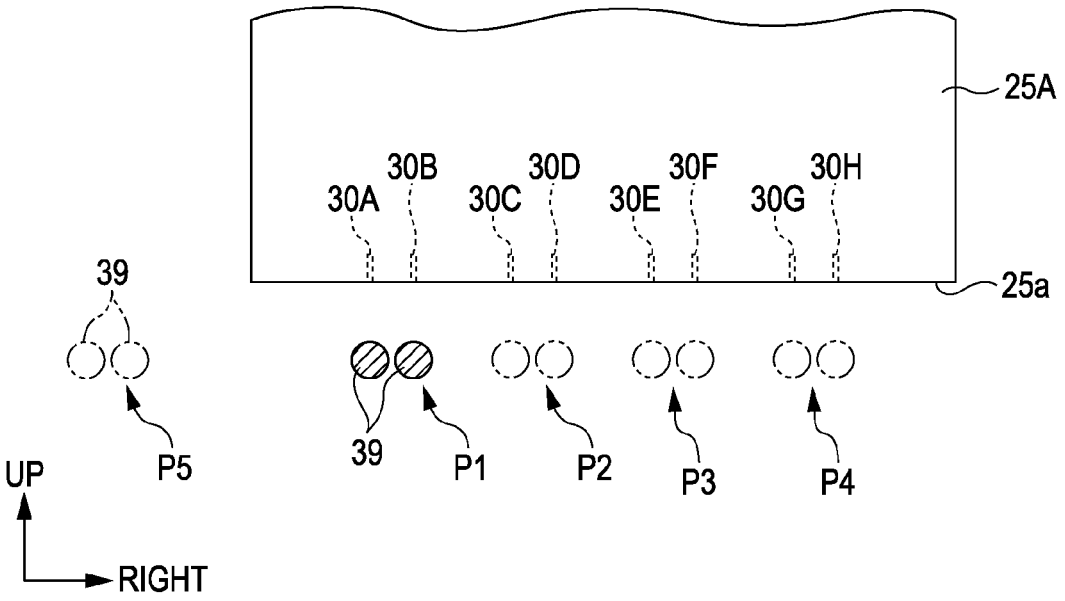
FIG. 5 is a front schematic diagram illustrating a printing head and describing a receiving position.
Figure 6:
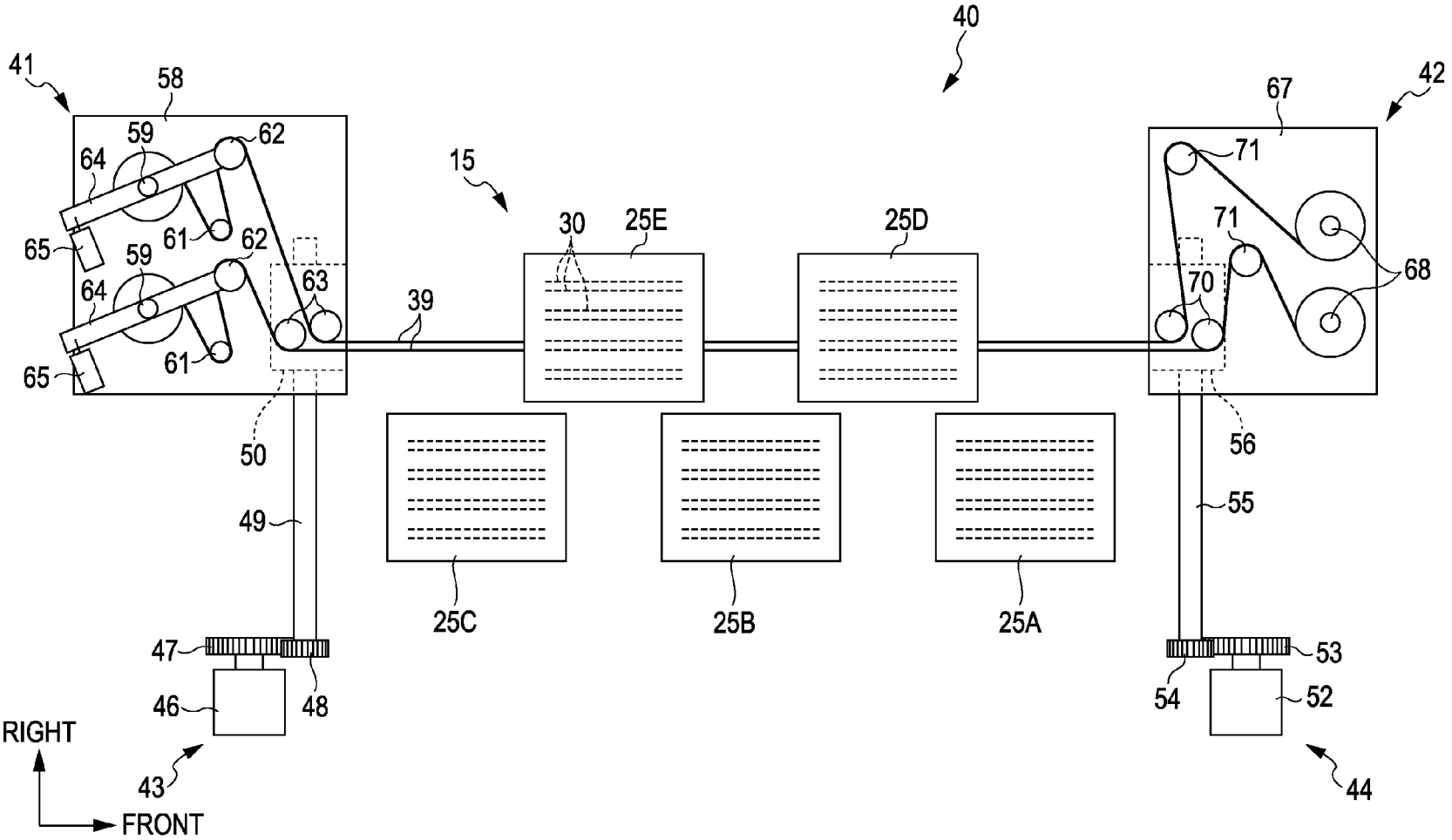
FIG. 6 is a schematic diagram illustrating the flushing unit that is located at a first position.

Further, as shown in FIGS. 5 and 6, the first position indicates a position in which each of the string members 39 faces each of the nozzle rows 30 in the vertical direction. That is, when the supply portion 41 and the winding portion 42 are located at the first position, the string member 39 is located at a position capable of receiving the ink ejected from the nozzle 29. Further, the first position and the receiving position are set in accordance with the number of the nozzle rows 30 and the string members 39, and in the embodiment, are set to eight positions (the number of the nozzle rows 30 located at different positions in the horizontal direction is divided by the number of the string members 39).

Specifically, as shown in FIG. 5, the position which is depicted by the solid line and in which the string members respectively face the first and second nozzle rows 30A and 30B of the first to third printing heads 25A to 25C disposed on the left side of the printing head unit 15 is set to a first receiving position P1. In the same way, the position in which the string members respectively face the third and fourth nozzle rows 30C and 30D is set to a second receiving position P2; the position in which the string members respectively face the fifth and sixth nozzle rows 30E and 30F is set to a third receiving position P3; and the position in which the string members respectively face the seventh and eighth nozzle rows 30G and 30H is set to a fourth receiving position P4.

Further, the positions in which the string members respectively face the first to eighth nozzle rows 30A to 30H of the fourth and fifth printing heads 25D and 25E disposed on the right side of the printing head 15 are set to fifth to eighth receiving positions (not shown). FIG. 6 shows a state in which the string members 39 are located at the sixth receiving position.

Then, when the control unit 73 drives the first and second movement motors 46 and 52 in the reverse direction while the supply portion 41 and the winding portion 42 are located at the first position, the supply portion 41 and the winding portion 42 move in the left direction so as to be located at the second position. Further, the second position indicates a position in which the string members 39 do not face the nozzle rows 30 in the vertical direction as shown in FIGS. 3 and 5. That is, when the supply portion 41 and the winding portion 42 are located at the second position, the string members 39 are located at a retreat position P5 that deviates from the first to fourth receiving positions P1 to P4 and the fifth to eighth receiving positions.

Next, the operation of the printer 11 with the above-described configuration and particularly the operation during the flushing process will be described on the basis of the timing chart shown in FIG. 7. Further, the supply portion 41 and the winding portion 42 are located at the second position at a timing other than the flushing process, and the string members 39 are located at the retreat position P5 while a second tensile force is applied thereto at the timing other than the flushing process. Further, as for the movement speeds of the supply portion 41 and the winding portion 42, the rightward movement is set to be positive, and the leftward movement is set to be negative.

Here, when the printing process starts in the printer 11, the control unit 73 creates an ink ejecting timing for each of the nozzles 29 on the basis of the printing data, and ejects the ink on the basis of the ejection timing. Then, the printing process is performed on the printing sheet 12 supported and transported by the transportation belt 22.

However, when the period during which the ink is not ejected from the nozzle 29 is long, the viscosity of the ink inside the nozzle 29 increases, which raises concerns that ejection errors may occur. Therefore, the control unit 73 performs the flushing process, in which the ink is ejected at an ejection timing different from the timing of the printing process, every predetermined interval.

Figure 7:
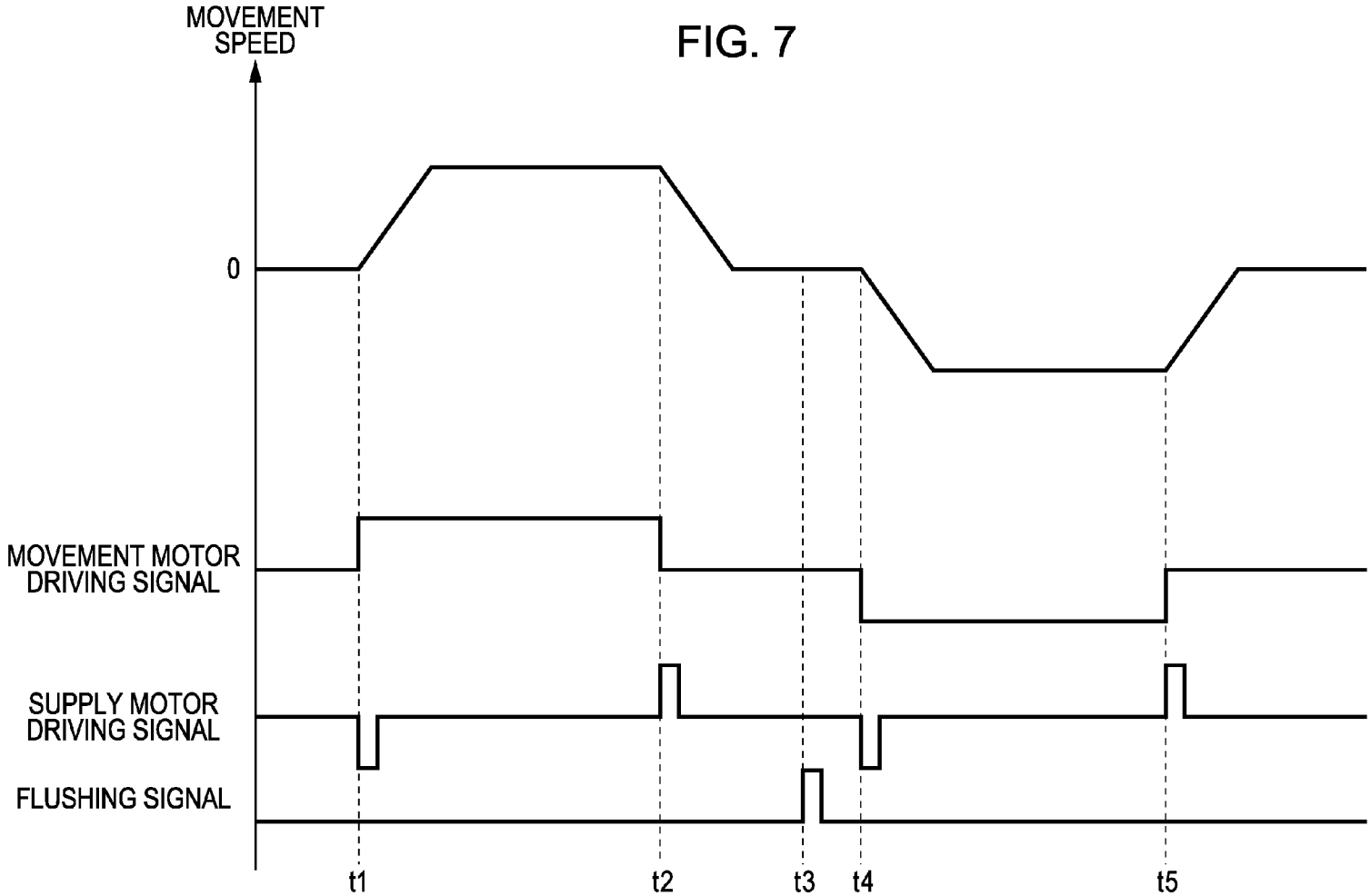
FIG. 7 is a timing chart illustrating a control during a flushing process.

Specifically, as shown in FIG. 7, the control unit 73 first outputs a normal rotation driving signal to the first and second movement motors 46 and 52 at the first timing t1. Then, the first and second movement motors 46 and 52 are driven in the normal direction, so that the supply portion 41 and the winding portion 42 are accelerated to move in the right direction. Further, the control unit 73 outputs a reverse rotation driving signal to the supply motor 60 at the first timing t1. Then, since the winding shaft 59 rotates in the reverse direction, the string members 39 supported by the supply portion 41 and the winding portion 42 move in the right direction while being wound on the winding shafts 59 and applying the first tensile force to the string members (movement procedure).

Then, the control unit 73 stops the output of the normal rotation driving signal to the first and second movement motors 46 and 52 at a second timing t2 so that the string members 39 are located at the first receiving position P1 corresponding to the first and second nozzle rows 30A and 30B on which the flushing process is performed. Subsequently, the first and second movement motors 46 and 52 stop, so that the supply portion 41 and the winding portion 42 are decelerated to stop at the first position. In addition, the control unit 73 outputs the normal rotation driving signal to the supply motor 60 at the second timing t2. Subsequently, since the winding shaft 59 rotates in the normal direction, the supply portion 41 and the winding portion 42 are decelerated so as to supply the string members 39 from the supply portion 41. Accordingly, the string members 39 decelerated together with the supply portion 41 and the winding portion 42 reach the first receiving position P1 while the magnitude of the tensile force applied thereto changes to the second tensile force smaller than the first tensile force (tensile force changing procedure).

That is, at the time when the string members 39 move from the retreat position P5 to the first receiving position P1, the first tensile force larger than the second tensile force is applied to the string members 39, and the tensile force changes to the second tensile force smaller than the first tensile force.

Further, the control unit 73 outputs a flushing signal to the printing head 25 at a third timing t3 after the supply portion 41 and the winding portion 42 are located at the first position, and ejects the ink from the nozzle rows 30 facing the string members 39. That is, the control unit 73 ejects the ink from the first and second nozzle rows 30A and 30B (fluid ejecting procedure).

Furthermore, the string members 39 move while the deformation thereof is suppressed by the large first tensile force applied thereto, and are located at the first receiving position P1 while the small second tensile force is applied to the string members so as to weaken the restoration force of the string members 39, and the vibration thereof is suppressed. Therefore, the ink ejected from the first and second nozzle rows 30A and 30B is received in the string member 39 located below the first and second nozzle rows 30A and 30B.

Moreover, the control unit 73 outputs the reverse rotation driving signal to the first and second movement motors 46 and 52 at the fourth timing t4 after the ink is ejected from the first and second nozzle rows 30A and 30B. Then, the first and second movement motors 46 and 52 are driven in the reverse direction, and the supply portion 41 and the winding portion 42 located at the first position are accelerated to move in the left direction. Further, the control unit 73 outputs the reverse rotation driving signal to the supply motor 60 at the fourth timing t4. Then, since the winding shaft 59 rotates in the reverse direction, the string members 39 supported by the supply portion 41 and the winding portion 42 move in the left direction while being wound on the winding shafts 59 and changing the tensile force to the first tensile force larger than the second tensile force.

Then, the control unit 73 stops the output of the reverse rotation driving signal to the first and second movement motors 46 and 52 at the fifth timing t5 so that the string members 39 are located at the retreat position P5. Subsequently, the first and second movement motors 46 and 52 stop, so that the supply portion 41 and the winding portion 42 are decelerated to stop at the second position. Further, the control unit 73 outputs the normal rotation driving signal to the supply motor 60 at the fifth timing t5. Then, since the winding shaft 59 rotates in the normal direction, the string members 39 decelerated together with the supply portion 41 and the winding portion 42 is located at the retreat position P5 while the tensile force applied thereto changes to the second tensile force smaller than the first tensile force.

Further, the control unit 73 outputs the normal rotation driving signal to the supply motor 60 and the collection motor 69 so as to wind the ink receiving portion of the string member 39 on the winding shaft 68, and to supply the new string member 39 from the winding shaft 59. That is, a portion of the string member 39 not having the ink received thereto is suspended between the supply portion 41 and the winding portion 42.

Furthermore, when the flushing process is performed on all nozzle rows 30, the control unit 73 further drives the first and second movement motors 46 and 52 in the normal direction from the state where the string member 39 is located at the first receiving position P1 so as to move the string member 39 to the second receiving position P2. At this time, the control unit 73 controls the driving of the solenoid 65, and pulls the left end of the arm 64 so as to enter a first state (not shown) in which the arm 64 rotates in the counter-clockwise direction in FIG. 3. That is, in the first state, the second roller 62 moves in a direction of increasing the tensile force of the string member 39, and the first tensile force is applied to the string member 39.

Then, the control unit 73 controls the driving of the solenoid 65 so as to enter a second state in which the arm 64 rotates in the clockwise direction in FIG. 3, and stops the driving of the first and second movement motors 46 and 52. That is, in the second state, the second roller 62 moves in a direction of weakening the tensile force of the string member 39, so that the tensile force applied to the string member 39 changes to the second tensile force smaller than the first tensile force. Accordingly, the string member 39 is located at the second receiving position P2 while the vibration is suppressed. Therefore, when the control unit 73 controls the first to third printing heads 25A to 25C and ejects the ink from the third and fourth nozzle rows 30C and 30D, the ink attaches and is received in the string member 39 located below the third and fourth nozzle rows 30C and 30D while the vibration of the string member is suppressed.

In the same way, the control unit 73 controls the driving of the first and second movement motors 46 and 52 so as to sequentially locate the string member 39 to the third and fourth receiving positions P3 and P4 and the fifth to eighth receiving positions, and controls the driving of the solenoid 65 so as to adjust the tensile force applied to the string member 39. Then, the control unit 73 controls the printing head 25 so as to perform the flushing process in which the ink is ejected from the nozzle row 30 facing the string member 39.

When the flushing process is performed on all nozzle rows 30, the control unit 73 drives the first and second movement motors 46 and 52 in the reverse direction so as to move the supply portion 41 and the winding portion 42 to the second position. Further, at this time, the control unit 73 drives the supply motor 60 in the normal direction so as to move the string members 39 while applying the first tensile force thereto, and drives the supply motor 60 in the reverse direction so as to move the string members 39 to the retreat position P5 while applying the second tensile force thereto.

According to the above-described embodiment, it is possible to obtain the advantages below.

(1) The control unit 73 drives the supply motor 60 so as to apply the first tensile force larger than the second tensile force to the string members 39 when the first and second movement mechanisms 43 and 44 move the supply portion 41 and the winding portion 42. Then, the string member 39 moves while the deformation thereof is suppressed. However, since the restoration force increases as the tensile force increases, if the string member 39 with a large tensile force applied is decelerated, there is a concern that the string member 39 may be vibrated even when the deformation amount thereof is small. Therefore, since the restoration force of the string member is weakened by changing the tensile force of the string member 39 to the second tensile force smaller than the first tensile force when the supply portion 41 and the winding portion 42 are located at the first position, it is possible to suppress the vibration of the string member. Accordingly, even when the string member 39 moves and stops at the receiving position capable of receiving the ink ejected from the nozzle 29, it is possible to rapidly and easily receive the ink ejected from the nozzle 29 by using the string member 39.

(2) When the supply portion 41 and the winding portion 42 are decelerated during its movement, the string member 39 supported by the supply portion 41 and the winding portion 42 may be vibrated by the restoration force of the string member 39 and the inertia force. For this reason, since the control unit 73 controls the supply motor 60 so as to change the tensile force applied to the string member 39 to the second tensile force smaller than the first tensile force before the supply portion 41 and the receiving portion 42 are located at the receiving position, the string member 39 reaches the receiving position while the restoration force thereof is weakened. That is, since the string member 39 is located at the receiving position while the vibration thereof is suppressed, it is possible to rapidly eject the ink thereto.

(3) It possible to easily change the tensile force applied to the string member 39 by rotating the winding shaft 59 on which the string member 39 is wound.

(4) It is possible to easily change the tensile force applied to the string member 39 in such a manner that the second roller 62 comes into contact with the string member 39 so as to deform the string member 39.

(5) The second roller 62 coming into contact with the string member 39 to deform the string member moves in accordance with the driving of the solenoid 65 having excellent responsiveness. Therefore, it is possible to suppress the vibration of the string member by changing the tensile force applied to the string member 39 even when the string member moves by, for example, a short distance between the nozzle rows 30. Further, it is possible to amplify the movement of the solenoid 65 and transmit the amplified movement to the second roller 62 by moving the second roller 62 via the arm 64.

(6) The diameter of the string member 39 changes in accordance with the tensile force applied to the string member. Then, a variation in the diameter prominently occurs particularly in the string member 39 having elasticity, and the amount of ink received decreases when the diameter thereof decreases. For this reason, the tensile force of the string member 39 located at the receiving position changes to the second tensile force smaller than the first tensile force, so that the string member 39 can face the nozzle 29 while the diameter thereof is large. Accordingly, it is possible to easily receive the ink by widening the range capable of facing the nozzle 29, and to increase the amount of ink received.

(7) Since the string member 39 moves in the space area formed between the nozzle formation surface 25*a* and the printing sheet 12, it is possible to perform the flushing process regardless of the transportation timing of the printing sheet 12. Further, even when the printing process is performed on the elongated and continuous sheet that is continuously supplied, it is possible to perform the flushing process.

Further, the above-described embodiment may be modified as below.

At least one of the supply motor 60 and the second roller 62 may be provided. That is, when the string member 39 moves, the tensile force of the string member 39 is adjusted by at least one of the supply motor 60 and the second roller 62, thereby suppressing the vibration of the string member 39 moved to the receiving position. In addition, the supply motor 60 and the second roller 62 may be driven at the same time to change the tensile force of the string member 39.

The control unit 73 may control the driving of the collection motor 69 and rotate the winding shaft 68 in accordance with the movement of the supply portion 41 and the winding portion 42 from the second position to the first position so as to change the tensile force of the string member 39. That is, the winding shaft 68 and the collection motor 69 may respectively serve as a winding shaft and a motor. Further, the control unit 73 may drive both the supply motor 60 and the collection motor 69 so as to change the tensile force of the string member 39.

The tensile force changing unit may change the tensile force of the string member 39 by relatively moving the supply portion 41 and the winding portion 42 in an arbitrary direction. Further, the tensile force changing unit may change the tensile force of the string member 39 by relatively moving the third roller 63 and the fourth roller 70 in the horizontal direction.

The tensile force changing unit may change the tensile forces of the string members 39 at a time by winding the plural string members 39 on one second roller 62 and moving the second roller 62.

The contact member may be provided so as to obliquely intersect the movement path of the string member 39. For example, the tensile force of the string member 39 may be changed in such a manner that the string member 39 moves on the contact member in accordance with the movement of the string member 39 to change the movement path of the string member. That is, the contact member may be disposed at a fixed position, and be relatively moved with respect to the string member 39 moving together with the supply portion 41 and the winding portion 42. In addition, the contact member may be disposed so as not to contact the string member 39, and may contact the string member 39 when changing the tensile force of the string member 39.

The control unit 73 may stop the string member 39 at the receiving position while applying the first tensile force thereto, and change the tensile force of the string member 39 located at the receiving position to the second tensile force.

A cleaning mechanism for cleaning the string member 39 receiving the ink may be provided, and the flushing process may be performed by supplying the string member 39 wound on the winding portion 42 to the supply portion 41 again.

The retreat position P5 of the string member 39 may be set to the lower side of the transportation path of the printing sheet 12 at a position facing the nozzle formation surface 25*a* of the printing head 25 in the vertical direction. That is, since the ink ejected from the nozzle 29 takes the form of mist, if the string member 39 is located to be away from the nozzle formation surface 25*a*, the string member cannot receive the ink even when facing the nozzle row 30. Therefore, the string member 39 may move between the retreat position on the lower side of the transportation path of the printing sheet 12 and the receiving position on the upper side of the transportation path of the printing sheet 12. Further, in the printer capable of disposing the string member 39 on the lower side of the transportation path of the printing sheet 12, the printing sheet 12 may be transported by a sheet feeding roller 23 and a sheet discharging roller 24 without using, for example, the transportation belt 22. Further, a receiving opening or a receiving hole may be provided in the transportation belt 22 or the platen 17, and the string member 39 may be received therein. In addition, the string member 39 may not be provided throughout the longitudinal direction of the printing head unit 15, but may be provided throughout, for example, the width corresponding to each of the printing heads 25.

The control unit 73 may change the tensile force applied to the string member 39 by controlling at least one of the supply motor 60 and the solenoid 65 only when the string member moves from the retreat position P5 to the receiving position P1, and may not change the tensile force between the receiving positions. That is, the string member 39 is located at the receiving position while its tensile force is adjusted and its vibration is suppressed. Further, since the distance between the receiving positions is shorter than the distance between the retreat position and each receiving position, even when the string member 39 moves between the receiving positions while vibrating, the amplitude thereof is small, and is rapidly attenuated compared with the case where the string member 39 moves from the retreat position P5 to the receiving position.

The string members 39 may set to have a length that can be supported by the supply portion 41 and the winding portion 42, and the string member may be supported by a support member not having a function of supplying and winding the string member so as to be movable in the horizontal direction.

The supply portion 41 and the winding portion 42 may be disposed in a fixed manner, and the third roller 63 and the fourth roller 70 may be adapted to be movable in the horizontal direction. That is, when the third roller 63 and the fourth roller 70 move in the right direction, the string member 39 also moves in the right direction along with the third roller 63 and the fourth roller 70. Further, it is desirable that the rotation of the supply motor 60 or the collection motor 69 be controlled in addition to the control of the third roller 63 and the fourth roller 70. That is, when the rotation of the supply motor 60 and the collection motor 69 is controlled, the tensile force of the string member is adjusted. Also, it is possible to prevent concern that the string member 39 may deviate from the third roller 63 and the fourth roller 70, and to prevent concern that the string member 39 may be damaged due to the excessive tensile force. In this case, the third roller 63 and the fourth roller 70 serve as support members. Further, as a support member movement mechanism for moving the third and fourth rollers 63 and 70, the supply portion 41, or the winding portion 42, a rack-and-pinion, a solenoid, a cam mechanism, and the like may be used.

The string member 39 may be formed of fiber such as silk or cotton, synthetic fiber such as polyamide (for example, nylon) or polyester, and metal such as stainless steel. That is, the string member may be formed of fiber such as PBO (poly-phenylene-benzobisoxazole, product name: Zylon), polyarylate, ultrahigh molecular weight polyethylene, aramid, or nylon applied with a hydrophobic coating, or compound fiber containing a plurality of these. More specifically, it is possible to form the string member 39 in such a manner that plural fiber bundles formed of the fiber or the compound fiber are twisted or bound. Then, when the string member 39 is formed by twisting the plural fiber bundles, it is possible to hold the ink even between the fiber bundles, and thus to increase the ink receiving amount. Further, the string member 39 may be formed of an elastic member such as rubber having excellent elasticity, and may be formed to have elasticity by forming the string member in, for example, a spiral shape. Further, the string member 39 may absorb the attached ink between the fibers, and also may receive the ink by surface tension or electrostatic force.

In the printing head unit 15, the plural printing heads 25 may not be arranged in a zigzag pattern, but one printing head may be provided to have a length corresponding to the width direction of the printing sheet 12. Further, the printer 11 is not limited to the line type, but may be a serial type printer or a lateral type printer equipped with the movable printing head 25. That is, the flushing process may be performed by moving the printing head 25 to the position of the flushing unit 40.

In the above-described embodiment, the fluid ejecting apparatus is embodied as the ink jet printer 11, but the invention may be applied to a fluid ejecting apparatus that ejects a fluid different from the ink. The invention may be applied to various fluid ejecting apparatuses that include a fluid ejecting head ejecting a minute amount of liquid droplets. In addition, the liquid droplets represent the fluid ejected from the fluid ejecting apparatus, and include a liquid having a particle shape, a tear shape, or a linear shape. Further, here, the fluid may be a material which can be ejected from the liquid ejecting apparatus. For example, the material may be in a liquid or gas state, and includes a liquid material such as sol or gel water having a high or low viscosity, a fluid material such as an inorganic solvent, an organic solvent, a liquid, a liquid resin, or liquid metal (metallic melt), and a material in which particles of a functional material formed of a solid material such as pigment or metal particles is dissolved, dispersed, or mixed with a solvent in addition to a fluid. In addition, ink or liquid crystals described in the above-described embodiment may be exemplified as a typical example of the fluid. Here, the ink indicates general water-based ink, oil-based ink, gel ink, or hot-melt ink which contains various fluid compositions. As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used. In addition, a fluid ejecting apparatus for ejecting lubricant from a pinpoint to a precise machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of these fluid ejecting apparatuses.

The entire disclosure of Japanese Patent Application No. 2009-295641, filed Dec. 25, 2009 is expressly incorporated by reference herein.

What is claimed is:

1. A fluid ejecting apparatus comprising:

a fluid ejecting head which includes nozzles ejecting a fluid;

a receiving member which is capable of receiving the fluid ejected from the nozzles and is linear;

a support member which supports the receiving member so as to extend in a linear shape;

a support member movement unit which moves the support member between a first position and a second position so that the receiving member is located at a receiving position capable of receiving the fluid ejected from the nozzles at the first position, and the receiving member is located at a retreat position deviating from the receiving position at the second position; and a tensile force changing unit that changes a tensile force applied to the receiving member from a first tensile force to a second tensile force smaller than the first tensile force when the support member movement unit moves the support member from the second position to the first position, wherein the second tensile force is applied to the receiving member while the receiving member receives the fluid ejected from the nozzles at the first position.

2. The fluid ejecting apparatus according to claim 1, wherein the support member movement unit accelerates and decelerates the support member so as to move the support member from the retreat position to the receiving position, and wherein the tensile force changing unit changes the tensile force applied to the receiving member from the first tensile force to the second tensile force when the support member movement unit decelerates the movement speed of the support member so as to stop the support member at the first position.

3. The fluid ejecting apparatus according to claim 1, wherein the support member is a winding shaft that winds and supports at least one end of the receiving member, and further includes a motor capable of rotationally driving the winding shaft in the normal and reverse directions, and wherein the tensile force changing unit changes the tensile force of the receiving member having the end wound on the winding shaft by rotating the winding shaft through the rotational driving of the motor.

4. The fluid ejecting apparatus according to claim 1, further comprising:

a contact member which is capable of coming into contact with the receiving member, wherein the tensile force changing unit changes the tensile force applied to the receiving member in such a manner that the contact member comes into contact with the receiving member to deform the receiving member while moving relative to the receiving member in a direction intersecting the extension direction of the receiving member.

5. A fluid receiving method of receiving a fluid ejected from nozzles into a receiving member supported to extend in a linear shape, the method comprising:

moving the receiving member toward a receiving position capable of receiving the fluid ejected from the nozzles while applying a tensile force to the receiving member;

changing the tensile force applied to the receiving member from a first tensile force to a second tensile force smaller than the first tensile force when the receiving member moves to the receiving position; and ejecting the fluid toward the receiving member stopping at the receiving position through the changing of the tensile force.

6. The fluid ejecting apparatus according to claim 1, wherein the fluid ejecting apparatus has a flushing process for maintenance of ejecting performance and a printing process for printing a medium, the receiving member is located at the receiving position capable of receiving the fluid ejected from the nozzles at the first position when the flushing process is performed, and the receiving member is located at the retreat position deviating from the receiving position at the second position when the printing process is performed.

* * * * *